US011289841B2

(12) United States Patent
Ikegami

(10) Patent No.: US 11,289,841 B2
(45) Date of Patent: Mar. 29, 2022

(54) CABLE CONNECTOR

(71) Applicant: KYOCERA CORPORATION, Kyoto (JP)

(72) Inventor: Fumihito Ikegami, Funabashi (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/261,419

(22) PCT Filed: Jul. 17, 2019

(86) PCT No.: PCT/JP2019/028122
§ 371 (c)(1),
(2) Date: Jan. 19, 2021

(87) PCT Pub. No.: WO2020/022152
PCT Pub. Date: Jan. 30, 2020

(65) Prior Publication Data

US 2021/0265756 A1 Aug. 26, 2021

(30) Foreign Application Priority Data

Jul. 27, 2018 (JP) ..... JP2018-141787

(51) Int. Cl.
*H01R 12/88* (2011.01)
*H01R 12/79* (2011.01)
*H01R 13/03* (2006.01)

(52) U.S. Cl.
CPC ..... *H01R 12/88* (2013.01); *H01R 12/79* (2013.01); *H01R 13/03* (2013.01)

(58) Field of Classification Search
CPC ..... H01R 12/88; H01R 12/79; H01R 12/70; H01R 12/85; H01R 12/77
(Continued)

(56) References Cited

U.S. PATENT DOCUMENTS 6,851,968 B2 2/2005 Tsunematsu
7,052,300 B2 * 5/2006 Okita ..... H01R 12/774 439/260
(Continued)

FOREIGN PATENT DOCUMENTS

CN 1476126 A 2/2004
JP 2004-039321 A 2/2004
(Continued)

*Primary Examiner* — Harshad C Patel
(74) *Attorney, Agent, or Firm* — Duane Morris LLP

(57) ABSTRACT

A cable connector comprises: a first terminal; a second terminal; an insulator having an insertion groove into and from which a plate-shaped connection object is insertable and removable; and an actuator. The first terminal rotatably supports the actuator by an engaging portion that engages an engaged portion of the actuator. The second terminal includes: a first arm portion including a first contact portion configured to come into contact with one surface of the connection object by elastically deforming in a plate thickness direction of the connection object; and a second arm portion facing the first arm portion in the plate thickness direction, and including, at a tip thereof, a second contact portion configured to come into contact with an other surface of the connection object. The first contact portion is a part of an elastic piece that extends from an end of the first arm portion so as to be folded back, at the end, toward a side toward which the connection object is inserted. The second contact portion is located more to a side toward which the connection object is removed, than the first contact portion.

6 Claims, 9 Drawing Sheets

(58) Field of Classification Search
USPC ..... 439/372, 326
See application file for complete search history.

(56) References Cited

U.S. PATENT DOCUMENTS 7,270,567 B2 * 9/2007 Inoue ..... H01R 12/79 439/495
7,347,720 B2 * 3/2008 Takashita ..... H01R 12/79 439/260
7,435,122 B2 * 10/2008 Suzuki ..... H01R 12/771 439/260
7,695,299 B2 * 4/2010 Tanaka ..... H01R 12/88 439/259
7,931,491 B2 * 4/2011 Takahashi ..... H01R 12/88 439/495
8,128,425 B2 * 3/2012 Takahashi ..... H01R 12/727 439/260
8,272,889 B2 * 9/2012 Matoba ..... H01R 12/88 439/495
8,641,439 B2 * 2/2014 Tateishi ..... H01R 12/88 439/260
9,153,888 B2 * 10/2015 Kajiura ..... H01R 12/88
9,225,097 B2 * 12/2015 Yokoo ..... H01R 12/77
9,780,472 B2 * 10/2017 Ishimaru ..... H01R 12/7005
10,205,260 B2 * 2/2019 Takemoto ..... H01R 12/88
2008/0242131 A1 * 10/2008 Tanaka ..... H01R 12/79 439/138
2009/0269986 A1 * 10/2009 Satoh ..... H01R 12/79 439/630
2011/0151709 A1 * 6/2011 Kim ..... H01R 13/2492 439/492
2012/0077366 A1 * 3/2012 Tsunemura ..... H01R 12/79 439/372
2013/0012071 A1 * 1/2013 Nakazu ..... H01R 12/88 439/630
2015/0024617 A1 * 1/2015 Yokoo ..... H01R 13/5213 439/136
2015/0118909 A1 * 4/2015 Yokoo ..... H01R 12/88 439/607.55
2016/0226169 A1 * 8/2016 Hoshino ..... H01R 13/2435
2017/0331211 A1 * 11/2017 Nakajima ..... H01R 12/79

FOREIGN PATENT DOCUMENTS

JP 2011-134488 A 7/2011
JP 2012-234646 A 11/2012
JP 2015-022851 A 2/2015
JP 2017-152335 A 8/2017

* cited by examiner

CABLE CONNECTOR

CROSS REFERENCE TO RELATED APPLICATION

This application claims priority to and the benefit of Japanese Patent Application No. 2018-141787 filed on Jul. 27, 2018, the entire disclosure of which is incorporated herein by reference.

TECHNICAL FIELD

The present disclosure relates to a cable connector.

BACKGROUND

In recent years, flexible printed circuits (FPCs) and flexible flat cables (FFCs) (hereafter also collectively referred to as "FPC or the like") are used in many electronic devices to improve workability in internal wiring. Connectors for electrically connecting FPCs or the like to printed circuit boards or the like in such electronic devices are known (for example, JP 2012-234646 A (PTL 1)).

CITATION LIST

Patent Literature

PTL 1: JP 2012-234646 A

SUMMARY

A connector according to an embodiment of the present disclosure comprises a first terminal, a second terminal, an insulator, and an actuator. The insulator supports the first terminal and the second terminal, and has an insertion groove into and from which a plate-shaped connection object is insertable and removable. The actuator includes an engaged portion that enables rotation with respect to the insulator. The first terminal rotatably supports the actuator by an engaging portion that engages the engaged portion. The second terminal includes a first arm portion and a second arm portion. The first arm portion includes a first contact portion configured to come into contact with one surface of the connection object by elastically deforming in a plate thickness direction of the connection object. The second arm portion faces the first arm portion in the plate thickness direction, and includes, at a tip thereof, a second contact portion configured to come into contact with an other surface of the connection object. The first contact portion of the second terminal is a part of an elastic piece that extends from an end of the first arm portion so as to be folded back, at the end, toward an insertion direction of the connection object. The first contact portion of the second terminal is located more to the side toward which the connection object is inserted, than the engaged portion of the actuator. The second contact portion of the second terminal is located more to a side toward which the connection object is removed, than the first contact portion of the second terminal.

DETAILED DESCRIPTION

The development of communication technologies in recent years has promoted the increase in the transmission rate of signals transmitted through a FPC or the like connecting the inside of an electronic device and a module or connecting modules. If the signal transmission rate is increased, there is a possibility that the electronic device malfunctions in the case where the FPC or the like is affected by external noise and/or in the case where electrical noise generated from the FPC or the like affects other components.

One measure against such noise is to use a FPC or the like having, on one surface or both surfaces, a ground layer usable as a ground. Thus, external noise affecting the FPC or the like can be blocked out. Moreover, electrical noise generated from the FPC or the like can be blocked out by the ground layer, and therefore kept from affecting other components. As a connector used in this case, a connector that comes into contact with the ground layer of the FPC or the like is known. In the case of using this connector, it is conventionally necessary to use different contacts in the connector depending on whether the ground layer is formed on one surface or both surfaces of the FPC or the like.

According to an embodiment of the present disclosure, a cable connector capable of electrical connection without being affected by whether a ground layer is formed on one surface or both surfaces of a plate-shaped connection object is provided.

Figure 1:
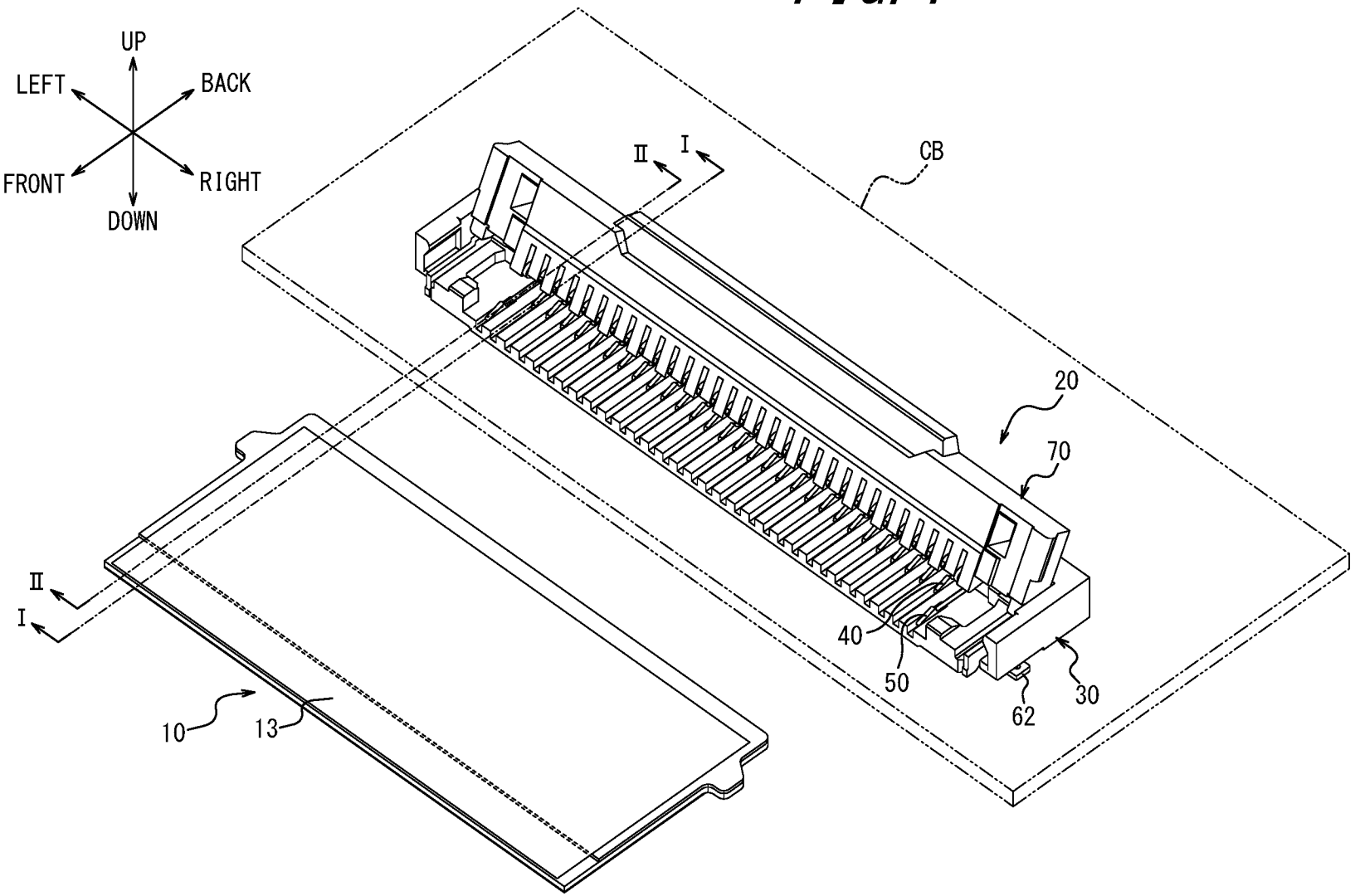
FIG. 1 is a perspective view of a connection object and a connector in a separated state according to an embodiment.

An embodiment of the present disclosure will be described below, with reference to the drawings. In the present disclosure, the up-down direction denotes a direction in which a connector 20 is placed on a circuit board CB, as illustrated in FIG. 1. The up-down direction also denotes a direction orthogonal to a plate-shaped connection object 10. The up-down direction corresponds to a plate thickness direction which is the thickness direction of the connection object 10. The front-back direction denotes an insertion-removal direction in which the connection object 10 is inserted into and removed from the connector 20, as illustrated in FIG. 1. The insertion-removal direction is a combination of an insertion direction in which the connection object 10 is inserted into the connector 20 and a removal direction in which the connection object 10 is removed from the connector 20. The insertion direction is a direction from front to back. The removal direction is a direction from back to front. The right-left direction denotes a direction in which first contacts 40, etc. are arranged, as illustrated in FIG. 1. The right-left direction also denotes a right-left direction when the connector 20 is seen from front.

Figure 2:
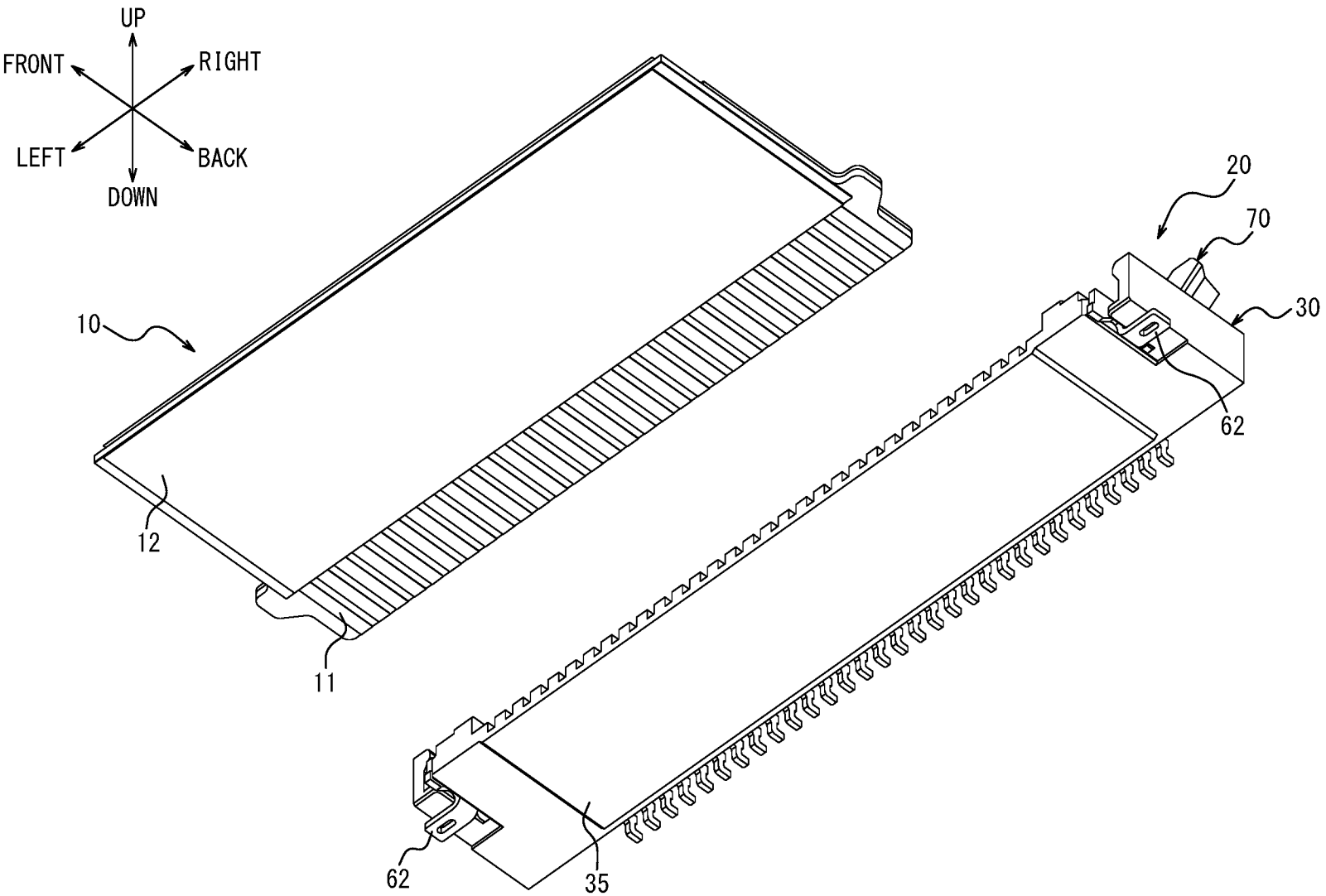
FIG. 2 is a perspective view of the connection object and the connector illustrated in FIG. 1 as seen from another direction.

FIG. 1 is a perspective view of the connection object 10 and the connector 20 in a separated state according to the embodiment. FIG. 2 is a perspective view of the connection object 10 and the connector 20 illustrated in FIG. 1 as seen from another direction.

The connection object 10 is plate-shaped, as illustrated in FIGS. 1 and 2. In the following description, the connection object 10 is assumed to be a FPC. The connection object 10 is, however, not limited to a FPC. The connection object 10 may be any structure having a plate shape insertable into the connector 20. For example, the connection object 10 may be a FFC. The connection object 10 is electrically connected to the circuit board CB illustrated in FIG. 1 via the connector 20. The circuit board CB may be a rigid board, or any other circuit board.

The connection object 10 is formed by bonding a plurality of thin film materials to each other. In other words, the connection object 10 has a laminated structure. The connection object 10 includes a conductive layer 11 for signals and ground layers 12 and 13 for grounding, as illustrated in FIGS. 1 and 2. Although the connection object 10 illustrated in FIGS. 1 and 2 includes the ground layers 12 and 13 for grounding on both surfaces, the connection object 10 according to the present disclosure may include a ground layer for grounding only on one surface.

The conductive layer 11 is made of any metal as an example, and shaped like a thin film. The conductive layer 11 is exposed near the back edge of the connection object 10, as illustrated in FIG. 2. The conductive layer 11 other than the part near the edge is covered with the ground layer 12. The conductive layer 11 is electrically connected to a signal pattern on the circuit board CB in FIG. 1 via the connector 20.

The ground layers 12 and 13 are each made of any metal as an example, and shaped like a thin film. The ground layers 12 and 13 are exposed near the back edge of the connection object 10, as illustrated in FIGS. 1 and 2. Each of the ground layers 12 and 13 other than the part near the edge may be covered with a cover film. The ground layer 13 is formed at the upper surface of the connection object 10, as illustrated in FIG. 1. The ground layer 12 is formed at the lower surface of the connection object 10, as illustrated in FIG. 2. The ground layers 12 and 13 are electrically connected to a ground pattern on the circuit board CB in FIG. 1 via the connector 20.

The connector 20 is a cable connector. The connector 20 is placed on the circuit board CB illustrated in FIG. 1. The connector 20 electrically connects the connection object 10 and the circuit board CB. The structure of the connector 20 will be described in detail below, with reference to FIGS. 3 to 10.

Figure 3:
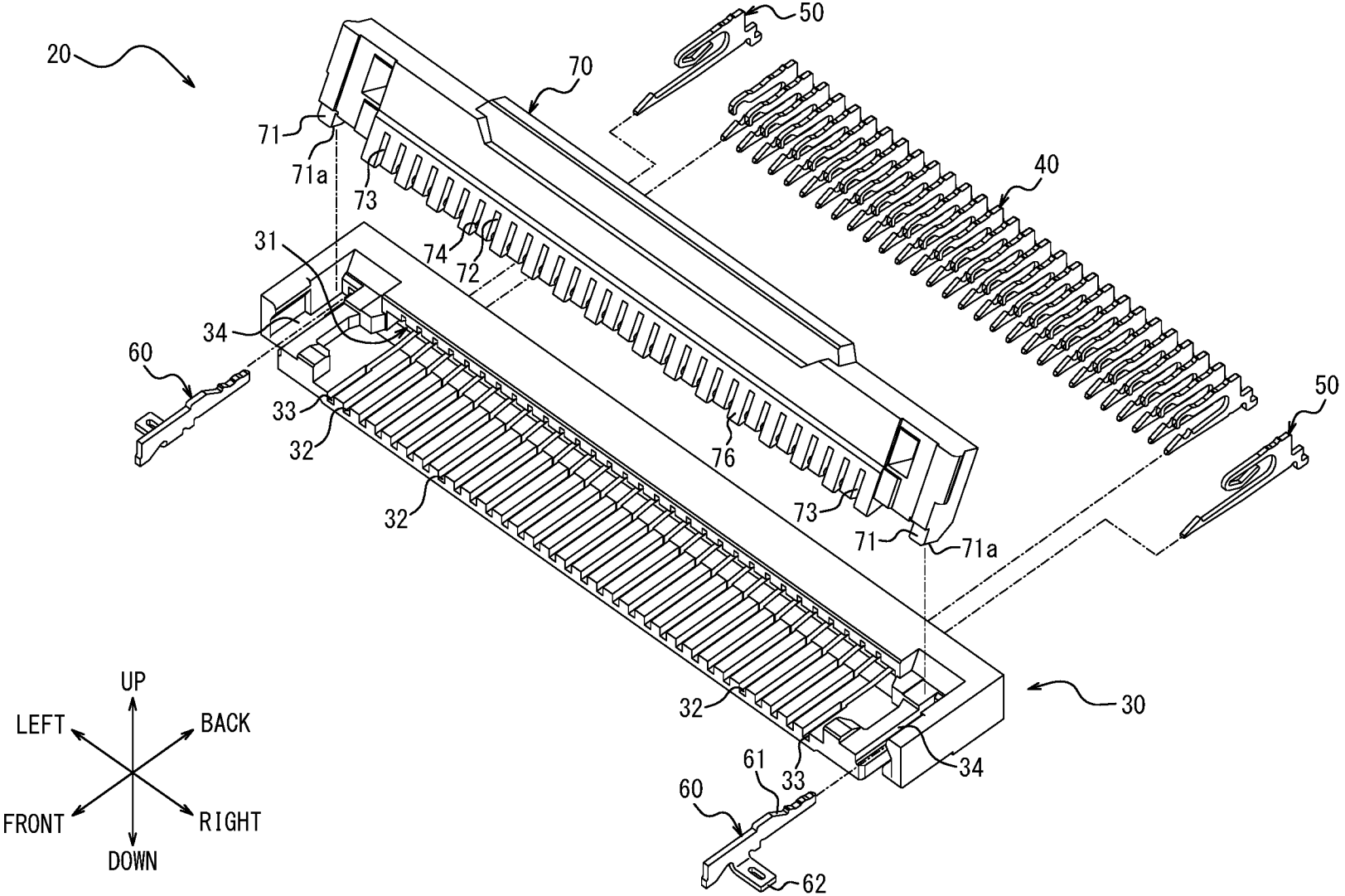
FIG. 3 is an exploded perspective view of the connector illustrated in FIG. 1.
Figure 4:
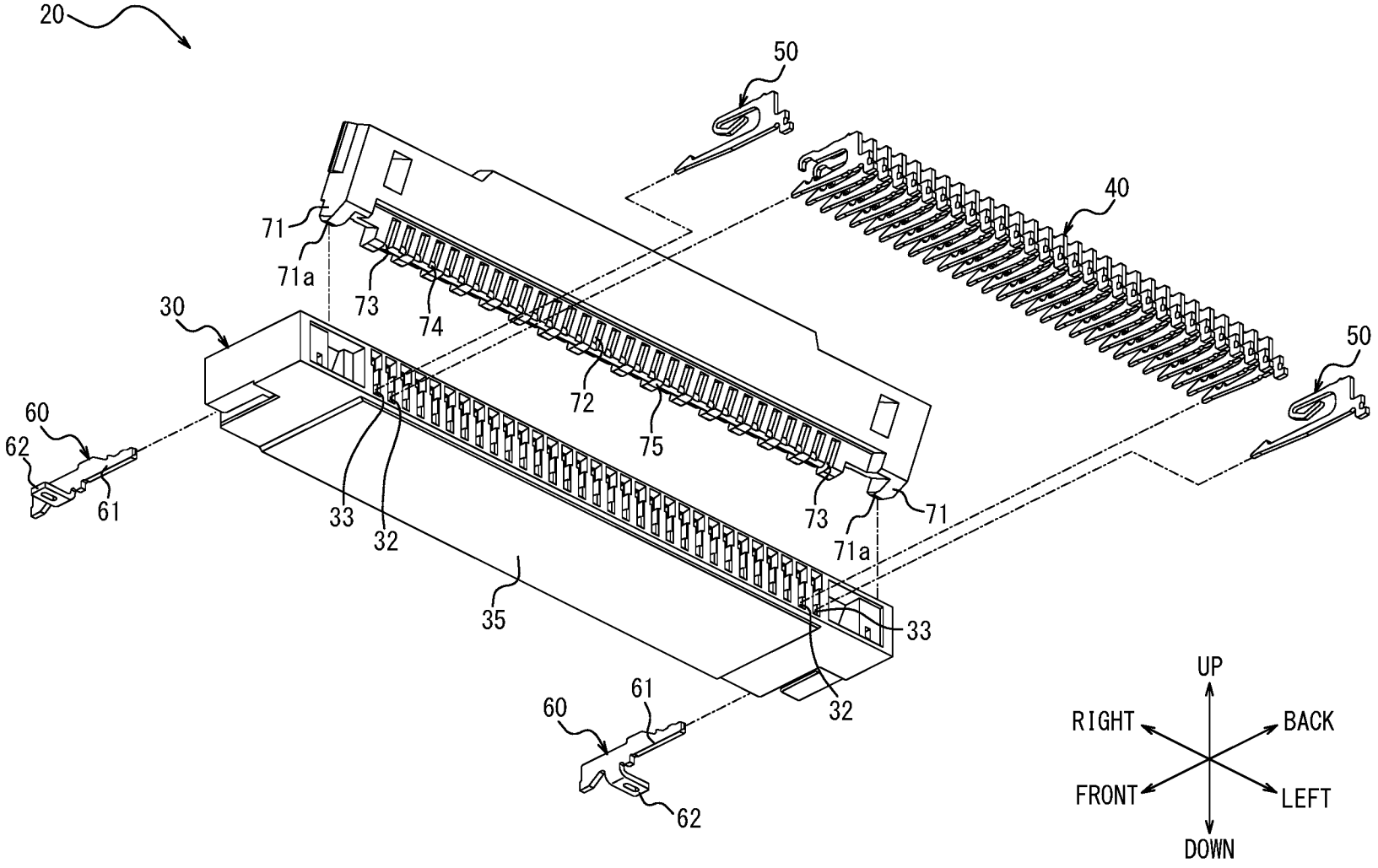
FIG. 4 is an exploded perspective view of the connector illustrated in FIG. 1 as seen from another direction.
Figure 5:
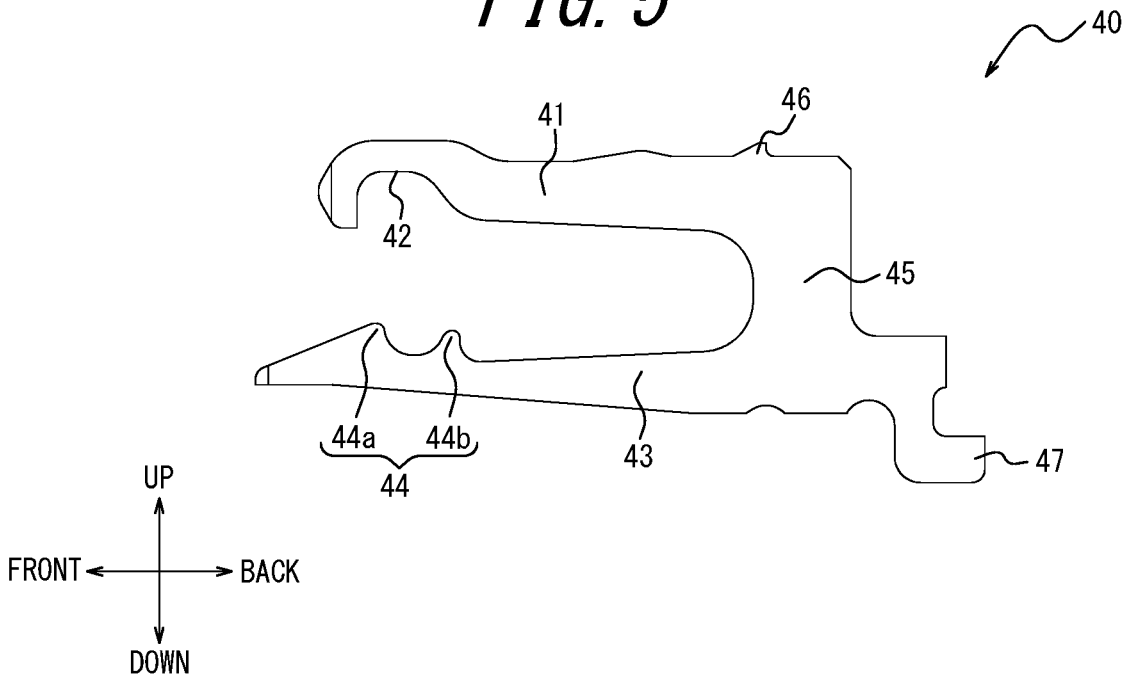
FIG. 5 is a side view of a first contact illustrated in FIG. 3.
Figure 6:
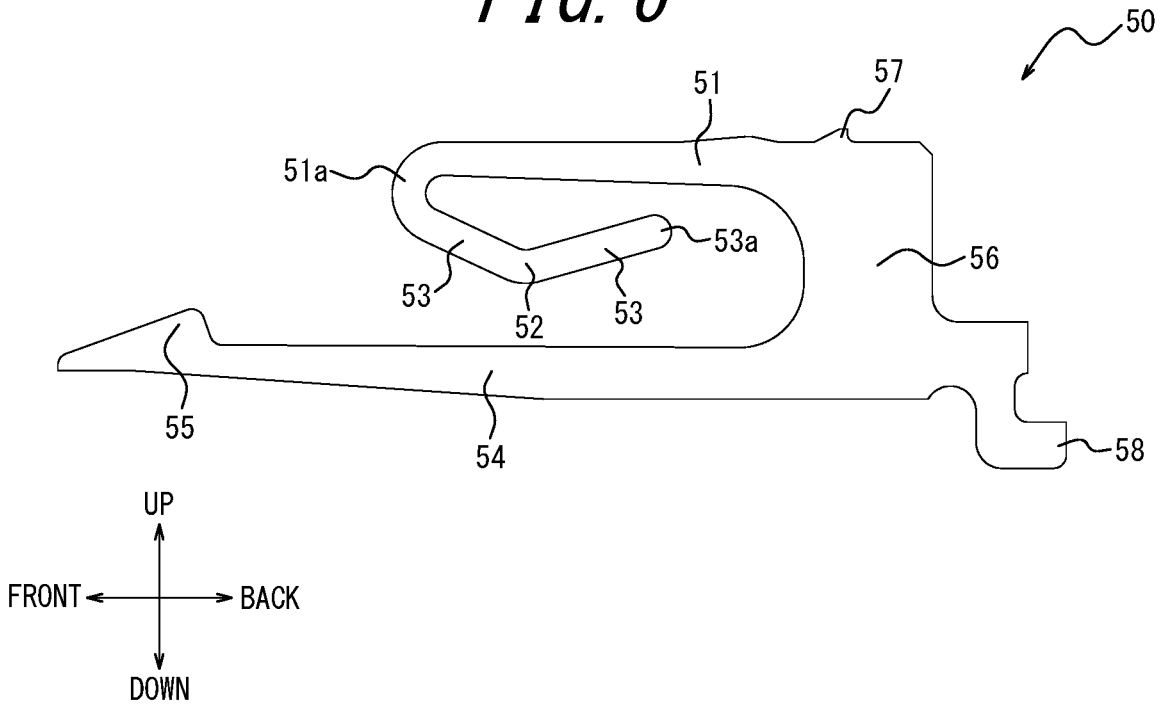
FIG. 6 is a side view of a second contact illustrated in FIG. 3.
Figure 7:
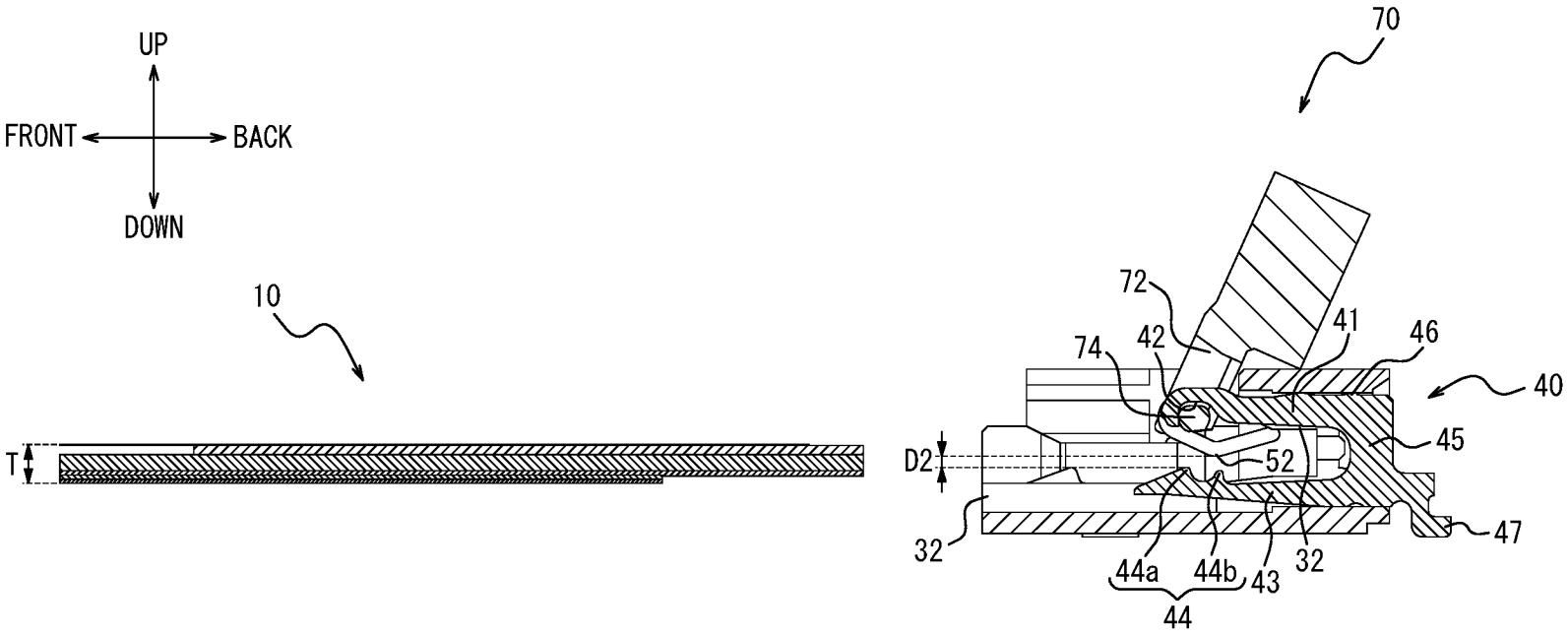
FIG. 7 is a sectional view of the connection object and the connector illustrated in FIG. 1 along line I-I.
Figure 8:
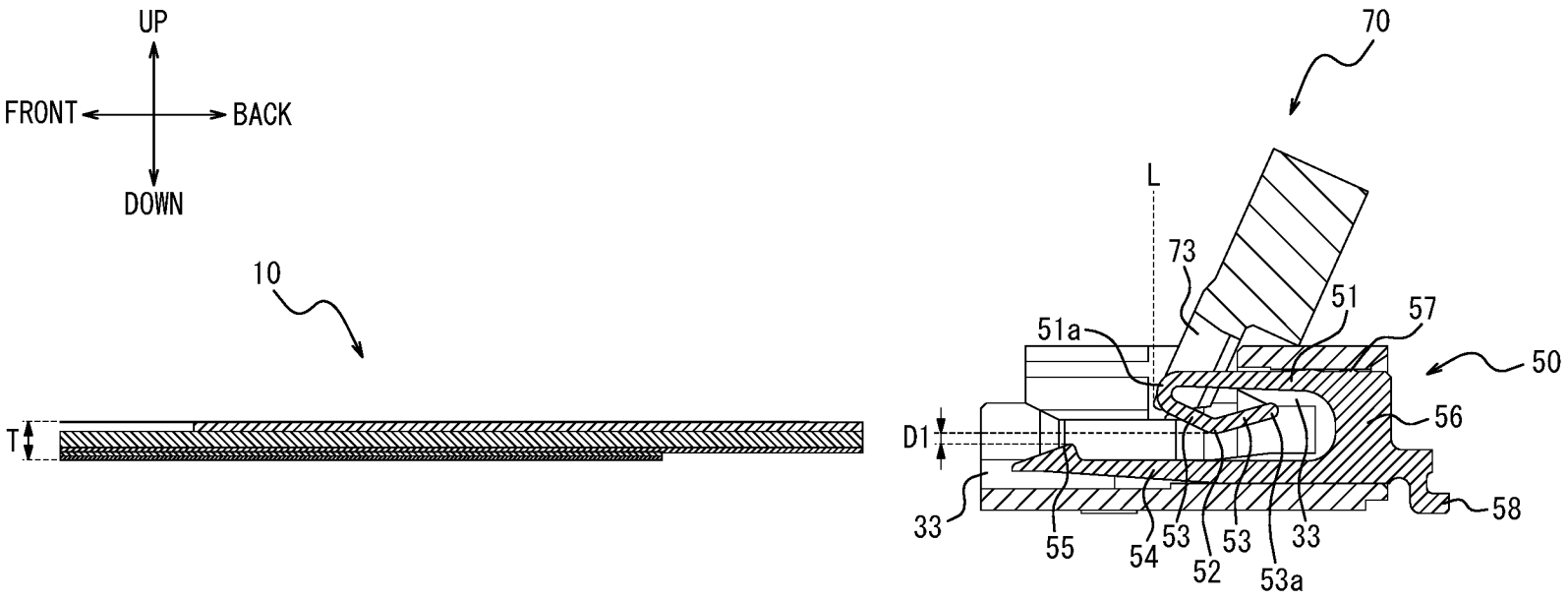
FIG. 8 is a sectional view of the connection object and the connector illustrated in FIG. 1 along line II-II.
Figure 9:
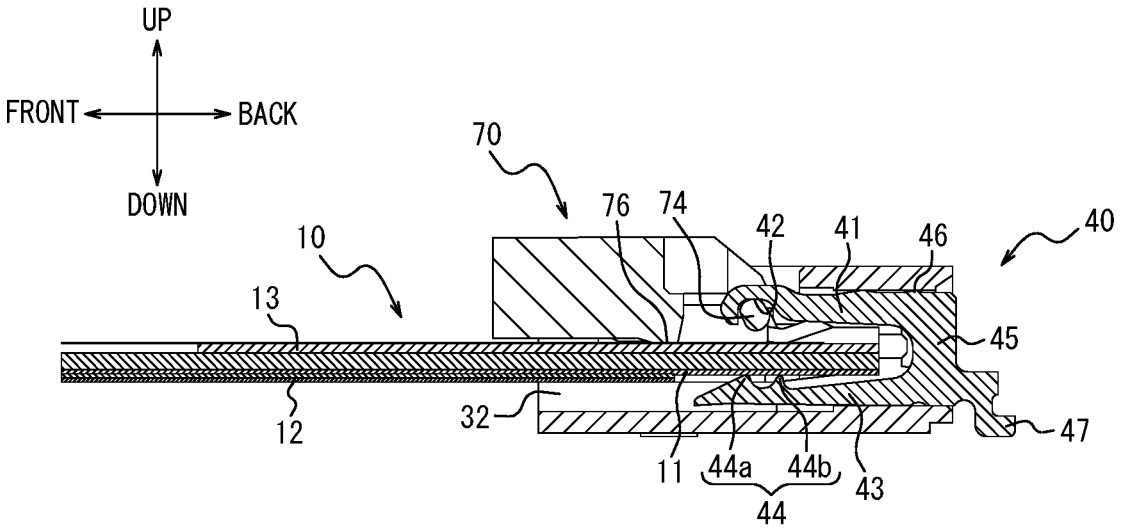
FIG. 9 is a sectional view corresponding to FIG. 7 when an actuator is rotated to a closed state in a state in which the connection object is inserted.
Figure 10:
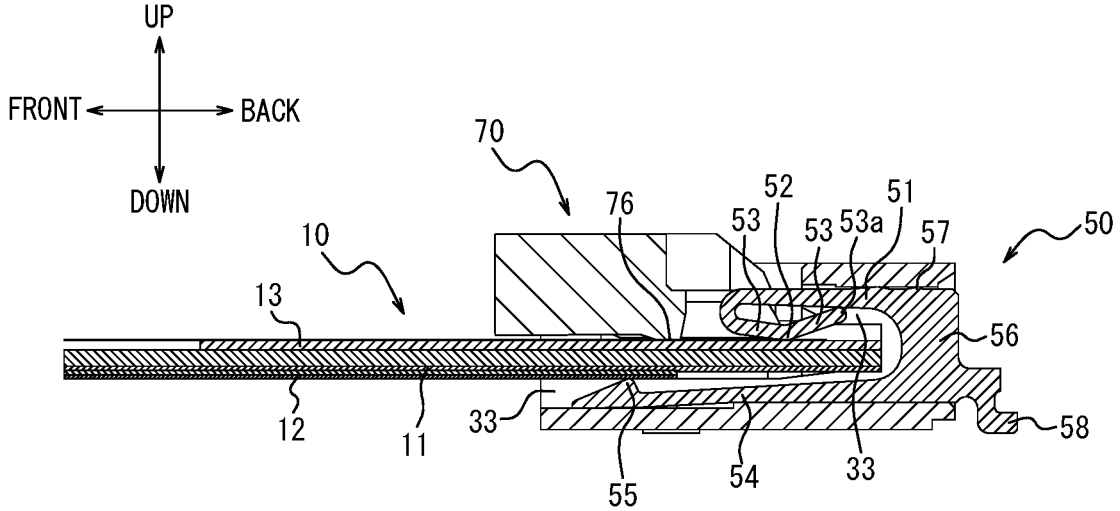
FIG. 10 is a sectional view corresponding to FIG. 8 when the actuator is rotated to the closed state in a state in which the connection object is inserted.

FIG. 3 is an exploded perspective view of the connector 20 illustrated in FIG. 1. FIG. 4 is an exploded perspective view of the connector 20 illustrated in FIG. 1 as seen from another direction. FIG. 5 is a side view of a first contact 40 illustrated in FIG. 3. FIG. 6 is a side view of a second contact 50 illustrated in FIG. 3. FIG. 7 is a sectional view of the connection object 10 and the connector 20 illustrated in FIG. 1 along line I-I. FIG. 8 is a sectional view of the connection object 10 and the connector 20 illustrated in FIG. 1 along line II-II. FIG. 9 is a sectional view corresponding to FIG. 7 when an actuator 70 is rotated to a closed state in a state in which the connection object 10 is inserted. FIG. 10 is a sectional view corresponding to FIG. 8 when the actuator 70 is rotated to the closed state in a state in which the connection object 10 is inserted.

In the present disclosure, the "open state of the actuator 70" denotes a state in which the actuator 70 is open with respect to an insulator 30 as illustrated in FIGS. 7 and 8. More specifically, the "open state of the actuator 70" denotes a state in which the actuator 70 has rotated in the insertion direction of the connection object 10 (i.e. backward). When the actuator 70 is in the open state, the connection object 10 can be inserted into and removed from the insulator 30. In the present disclosure, the "closed state of the actuator 70" denotes a state in which the actuator 70 is closed with respect to the insulator 30 as illustrated in FIGS. 9 and 10. More specifically, the "closed state of the actuator 70" denotes a state in which the actuator 70 has rotated in the removal direction of the connection object 10 (i.e. forward). When the actuator 70 is in the closed state, the connection object 10 inserted in the insulator 30 is fixed to the insulator 30.

The connector 20 includes the insulator 30, the first contacts 40 each as a first terminal, second contacts 50 each as a second terminal, fixed metal fittings 60, and the actuator 70, as illustrated in FIGS. 3 and 4. Although the second contacts 50 are located at both ends of the arrangement of the first contacts 40 in the connector 20 illustrated in FIGS. 3 and 4, the placement of the second contacts 50 is not limited to such. For example, the second contacts 50 may be arranged at predetermined intervals (for example, at intervals of two first contacts 40) along the arrangement of the first contacts 40. More specifically, an arrangement of one second contact 50, two first contacts 40, and one second contact 50 in this order may be provided in the contact arrangement direction (right-left direction).

The insulator 30 is a bilaterally symmetrical box-shaped member as illustrated in FIGS. 3 and 4. The insulator 30 may be formed in a box shape by injection molding an insulating and heat-resistant synthetic resin material. The insulator 30 supports the first contacts 40 and the second contacts 50. The connection object 10 illustrated in FIG. 1 is insertable into and removable from the insulator 30. The insulator 30 has an insertion groove 31, first insertion openings 32, second insertion openings 33, installation grooves 34, and a bottom wall 35, as illustrated in FIGS. 3 and 4.

The insertion groove 31 is formed throughout the length of the insulator 30 in the right-left direction, as illustrated in FIG. 3. The insertion groove 31 is open forward. The insertion groove 31 extends to the inside of the insulator 30. The connection object 10 illustrated in FIG. 1 is inserted into and removed from the insertion groove 31. The connection object 10 is insertable into and removable from the insertion groove 31. The actuator 70 is located above the insertion groove 31 illustrated in FIG. 3.

The first insertion openings 32 are formed at the inner surface of the insertion groove 31, as illustrated in FIG. 3. For example, the lower part of each first insertion opening 32 is located at the lower inner surface of the insertion groove 31, as illustrated in FIG. 7. The upper part of each first insertion opening 32 is located at the upper inner surface of the insertion groove 31, as illustrated in FIG. 7. The first insertion openings 32 pass through the back surface of the insulator 30, as illustrated in FIG. 4. The surface shape of each first insertion opening 32 along the lower surface of the insulator 30 is a rectangular shape having the long sides in the front-back direction and the short sides in the right-left direction, as illustrated in FIG. 3. The first contacts 40 are press-fitted into the first insertion openings 32 from behind, as illustrated in FIG. 7. As a result of the first contacts 40 being press-fitted into the first insertion openings 32, the insulator 30 supports the first contacts 40.

The arrangement and size of the first insertion openings 32 may be adjusted as appropriate depending on the arrangement and size of the first contacts 40. For example, in the case where the plurality of first contacts 40 are arranged in the right-left direction away from each other at predetermined intervals, the plurality of first insertion openings 32 may be arranged in the right-left direction away from each other at the predetermined intervals so as to correspond to the first contacts 40, as illustrated in FIG. 3. The respective lower inner surfaces of the plurality of first insertion openings 32 arranged in the right-left direction may approximately match in the position in the front-back direction. The length of the long sides of each first insertion opening 32 and the length of the short sides of the first insertion opening 32 may be slightly greater than the front-back width and the right-left width of the corresponding first contact 40 respectively, as long as the first contact 40 can be inserted and held in the first insertion opening 32.

The second insertion openings 33 are formed at the inner surface of the insertion groove 31, as illustrated in FIG. 3. For example, the lower part of each second insertion opening 33 is located at the lower inner surface of the insertion groove 31, as illustrated in FIG. 8. The upper part of each second insertion opening 33 is located at the upper inner surface of the insertion groove 31, as illustrated in FIG. 8. The second insertion openings 33 pass through the back surface of the insulator 30, as illustrated in FIG. 4. The surface shape of each second insertion opening 33 along the lower surface of the insulator 30 is a rectangular shape having the long sides in the front-back direction and the short sides in the right-left direction, as illustrated in FIG. 3. The second contacts 50 are press-fitted into the second insertion openings 33 from behind, as illustrated in FIG. 8. As a result of the second contacts 50 being press-fitted into the second insertion openings 33, the insulator 30 supports the second contacts 50.

The arrangement and size of the second insertion openings 33 may be adjusted as appropriate depending on the arrangement and size of the second contacts 50. For example, in the case where the second contacts 50 are arranged at both ends of the arrangement of the first contacts 40, the second insertion openings 33 may be arranged at the right and left ends of the insertion groove 31 so as to correspond to the second contacts 50, as illustrated in FIG. 3. In the case where the second contacts 50 are arranged at predetermined intervals along the arrangement of the first contacts 40, the second insertion openings 33 may be arranged at the predetermined intervals so as to correspond to the second contacts 50. In this case, the respective lower inner surfaces of the plurality of second insertion openings 33 may approximately match in the position in the front-back direction. The length of the long sides of each second insertion opening 33 and the length of the short sides of the second insertion opening 33 may be slightly greater than the front-back width and the right-left width of the corresponding second contact 50 respectively, as long as the second contact 50 can be inserted and held in the second insertion opening 33.

The installation grooves 34 are arranged near the right and left ends of the insulator 30, as illustrated in FIG. 3. The installation grooves 34 extend in the front-back direction. The installation grooves 34 are open forward. The fixed metal fittings 60 are press-fitted into the installation grooves 34 from front.

The bottom wall 35 is formed at the outer lower surface of the insulator 30, as illustrated in FIG. 4. The bottom wall 35 is located between the circuit board CB and the respective lower inner surfaces of the first insertion openings 32 and the respective lower inner surfaces of the second insertion openings 33 when the connector 20 is placed on the circuit board CB.

The first contact 40 illustrated in FIGS. 5 and 7 is approximately U-shaped in a side view. For example, the first contact 40 may be formed by subjecting a thin plate of a copper alloy or a corson copper alloy having spring elasticity, such as phosphor bronze, beryllium copper, or titanium copper, to progressive molding (stamping). The first contact 40 is formed only by blanking a material which is a thin plate. More specifically, the first contact 40 is formed by the same plane in the right-left direction. The first contact 40 may be formed by blanking a material which is a thin plate and then bending it.

A base plating as a base is formed on the surface of the first contact 40. A surface layer plating is formed on part of the upper surface of the base plating. The base plating is, for example, made of a material such as nickel, a palladium-nickel alloy, or copper, and has low wettability for solder and flux. The surface layer plating is, for example, made of a material such as gold, silver, tin, or a tin copper alloy, and has high wettability for solder and flux. For example, the surface of the first contact 40 may have the surface layer plating only in parts important for electrical signal transmission such as a mounted portion for the circuit board CB and a contact portion for the connection object 10, and have the base plating in the other parts. The surface of the first contact 40 may have the base plating only in an optimal region and have the surface layer plating in all other parts, in order to prevent solder wicking and flux wicking. To effectively prevent solder wicking and flux wicking, in the optimal region of the first contact 40, the base plating needs to be exposed to the surfaces in all directions included in the region.

The first contact 40 illustrated in FIGS. 5 and 7 electrically connects the signal pattern on the circuit board CB and the conductive layer 11 of the connection object 10 illustrated in FIG. 9. The first contact 40 supports a rotation shaft 74 of the actuator 70, thus rotatably supporting the actuator 70. The first contact 40 includes a first arm portion 41 including a recess 42 (engaging portion) at its tip, a second arm portion 43 including a contact portion 44 at its tip, a support portion 45, and a mounted portion 47, as illustrated in FIG. 7.

The first arm portion 41 extends forward from the support portion 45, as illustrated in FIGS. 5 and 7. The recess 42 is formed at the tip of the first arm portion 41. The recess 42 is open downward, as illustrated in FIG. 7. The recess 42 engages the rotation shaft 74 of the actuator 70. As a result of the recess 42 as the engaging portion engaging the rotation shaft 74 as the engaged portion of the actuator 70, the first contact 40 rotatably supports the actuator 70.

The second arm portion 43 is located directly below the first arm portion 41 so as to face the first arm portion 41 in the plate thickness direction of the connection object 10, i.e. the up-down direction. The second arm portion 43 extends forward from the support portion 45, as illustrated in FIGS. 5 and 7. The contact portion 44 is formed at the tip of the second arm portion 43. The contact portion 44 projects upward. The contact portion 44 comes into contact with the other surface of the connection object 10, i.e. the conductive layer 11 of the connection object 10, as illustrated in FIG. 9. The tip of the second arm portion 43 may be located higher than the back end of the second arm portion 43, as illustrated in FIGS. 5 and 7. This structure increases the pressing force from the contact portion 44 to the connection object 10 illustrated in FIG. 9. As a result of the increase of the pressing force from the contact portion 44 to the connection object 10 illustrated in FIG. 9, the reliability of the connection between the contact portion 44 and the conductive layer 11 of the connection object 10 can be enhanced.

The contact portion 44 may include a third contact portion 44*a* and a fourth contact portion 44*b*, as illustrated in FIG. 5 and FIG. 9. The third contact portion 44*a* and the fourth contact portion 44*b* each come into contact with the conductive layer 11 of the connection object 10, as illustrated in FIG. 9. With such a structure, the first contact 40 can come into contact with the conductive layer 11 at two contact points by the third contact portion 44*a* and the fourth contact portion 44*b*. As a result of the first contact 40 and the conductive layer 11 coming into contact with each other at two contact points, the reliability of the contact between the first contact 40 and the conductive layer 11 can be enhanced. The third contact portion 44*a* may be located more to the side (removal side) toward which the connection object 10 is removed, i.e. the front side, than the fourth contact portion 44*b*. With such a structure, in the case where foreign matter adheres to the conductive layer 11 when inserting the connection object 10, the foreign matter can be removed by wiping using the third contact portion 44*a* before the fourth contact portion 44*b* comes into contact with the conductive layer 11. This further enhances the reliability of the contact between the first contact 40 and the conductive layer 11.

The support portion 45 illustrated in FIGS. 5 and 7 supports the first arm portion 41 and the second arm portion 43. For example, the upper part of the support portion 45 is connected to the back end of the first arm portion 41. The lower part of the support portion 45 is connected to the back end of the second arm portion 43.

The upper part of the support portion 45 has a projection portion 46, as illustrated in FIGS. 5 and 7. The projection portion 46 bites into the upper inner surface of the first insertion opening 32 of the insulator 30. The lower part of the support portion 45 is supported by the lower inner surface of the first insertion opening 32 of the insulator 30. With such a structure, the first contact 40 is held in the first insertion opening 32.

The mounted portion 47 projects backward from the back surface of the insulator 30, as illustrated in FIG. 7. The lower surface of the mounted portion 47 is located lower than the lower surface of the insulator 30. The mounted portion 47 is mounted on the signal pattern on the circuit board CB illustrated in FIG. 1. For example, the mounted portion 47 is mounted by being placed on a solder paste applied on the circuit board CB.

The second contact 50 illustrated in FIGS. 6 and 8 is approximately U-shaped in a side view. For example, the second contact 50 may be formed by subjecting a thin plate of a copper alloy or a corson copper alloy having spring elasticity, such as phosphor bronze, beryllium copper, or titanium copper, to progressive molding (stamping), as with the first contact 40. The second contact 50 is formed only by blanking a material which is a thin plate. More specifically, the second contact 50 is formed by the same plane in the right-left direction. The second contact 50 may be formed by blanking a material which is a thin plate and then bending it.

A base plating and a surface layer plating may be formed on the surface of the second contact 50, as with the first contact 40. The surface of the second contact 50 may have the base plating only in an optimal region and have the surface layer plating in all other parts in order to prevent solder wicking and flux wicking, as with the first contact 40. To effectively prevent solder wicking and flux wicking, in the optimal region of the second contact 50, the base plating needs to be exposed to the surfaces in all directions included in the region.

The second contact 50 illustrated in FIGS. 6 and 8 electrically connects the ground pattern on the circuit board CB and the ground layers 12 and 13 of the connection object 10 illustrated in FIG. 10. The second contact 50 includes a first arm portion 51 including a first contact portion 52, a second arm portion 54 including a second contact portion 55 at its tip, a support portion 56, and a mounted portion 58, as illustrated in FIG. 8.

The first arm portion 51 extends forward from the support portion 56, as illustrated in FIGS. 6 and 8. An end 51*a* of the first arm portion 51 does not project more to the side toward which the connection object 10 is removed, i.e. the front side, than the actuator 70 when the actuator 70 is in the open state as illustrated in FIG. 8. That is, the end 51*a* of the first arm portion 51 does not project forward from line L illustrated in FIG. 8. With such a structure, when inserting the connection object 10 into the insertion groove 31 of the insulator 30 illustrated in FIG. 3, the connection object 10 can be prevented from abutting the end 51*a* of the first arm portion 51. As a result of the connection object 10 being prevented from abutting the end 51*a* of the first arm portion 51, the connection object 10 can be smoothly inserted into the insertion groove 31 of the insulator 30 illustrated in FIG. 3. Since the connection object 10 can be prevented from abutting the end 51*a* of the first arm portion 51 when inserting the connection object 10 into the insertion groove 31, deformation of the first arm portion 51 can be suppressed.

The first arm portion 51 includes the first contact portion 52. The first contact portion 52 comes into contact with one surface of the connection object 10, i.e. the ground layer 13 of the connection object 10, as illustrated in FIG. 10. The first contact portion 52 elastically deforms in the plate thickness direction of the connection object 10, i.e. the up-down direction. For example, the first contact portion 52 may be a part of an elastic piece 53. The elastic piece 53 may extend from the end 51*a* of the first arm portion 51 so as to be folded, at the end 51*a*, toward the back of the first arm portion 51, as illustrated in FIG. 8. The elastic piece 53 may be bent at an approximately center part so as to project toward the second arm portion 54. In this case, the first contact portion 52 may be the approximately center part of the elastic piece 53. As a result of the elastic piece 53 having such a folding structure, the displacement by the elastic deformation of the first contact portion 52 can be increased. The first contact portion 52 may be located more to the side (insertion side) toward which the connection object 10 is inserted, i.e. the back side, than the rotation shaft 74 of the actuator 70, as illustrated in FIG. 8. With such a structure, the displacement by the elastic deformation of the first contact portion 52 can be increased even when the end of the second contact 50 is not located more to the removal side, i.e. the front side, than the rotation shaft 74 of the actuator 70.

Part of the tip 53*a* of the elastic piece 53 may be housed in the upper part of the second insertion opening 33 of the insulator 30 when the actuator 70 is in the open state as illustrated in FIG. 8. When the connection object 10 is inserted in the insertion groove 31 of the insulator 30, the elastic piece 53 is pressed upward by the connection object 10. If part of the tip 53*a* of the elastic piece 53 is housed in the upper part of the second insertion opening 33 beforehand, when the elastic piece 53 is pressed upward, the elastic piece 53 can be smoothly housed in the upper part of the second insertion opening 33 as illustrated in FIG. 10. As a result of the elastic piece 53 being smoothly housed in the upper part of the second insertion opening 33 when the connection object 10 is inserted into the insertion groove 31 of the insulator 30, misalignment of the second contact 50 in the right-left direction and deformation of the elastic piece 53 can be prevented.

The second arm portion 54 is located directly below the first arm portion 51 so as to face the first arm portion 51 in the plate thickness direction of the connection object 10, i.e. the up-down direction, as illustrated in FIG. 8. The second arm portion 54 extends forward from the support portion 56. The second contact portion 55 is formed at the tip of the second arm portion 54. The second contact portion 55 projects upward. The second contact portion 55 comes into contact with the other surface of the connection object 10, i.e. the ground layer 12 of the connection object 10, as illustrated in FIG. 10. The second arm portion 54 is longer than the first arm portion 51 in the insertion-removal direction in which the connection object 10 is inserted and removed, i.e. the front-back direction, as illustrated in FIG. 8. With such a structure, the second contact portion 55 can come into contact with the ground layer 12 without being in contact with the conductive layer 11 for signals, as illustrated in FIG. 10. The tip of the second arm portion 54 may be located higher than the back end of the second arm portion 54, as illustrated in FIG. 8. This structure increases the pressing force from the second contact portion 55 to the connection object 10 illustrated in FIG. 10. As a result of the increase of the pressing force from the second contact portion 55 to the connection object 10 illustrated in FIG. 10, the reliability of the contact between the second contact portion 55 and the ground layer 12 of the connection object 10 can be enhanced.

The distance D1 between the first contact portion 52 and the second contact portion 55 may be less than the thickness T of the connection object 10 in the direction in which the connector 20 is placed on the circuit board CB, i.e. the up-down direction, as illustrated in FIG. 8. With such a structure, the first contact portion 52 and the second contact portion 55 can press the connection object 10 from above and below, as illustrated in FIG. 10. Thus, the reliability of the contact between the first contact portion 52 and the ground layer 13 of the connection object 10 and the reliability of the contact between the second contact portion 55 and the ground layer 12 of the connection object 10 can be enhanced.

The distance D2 between the first contact portion 52 and the contact portion 44 (third contact portion 44*a* or fourth contact portion 44*b*) of the first contact 40 may be less than the thickness T of the connection object 10 in the direction in which the connector 20 is placed on the circuit board CB, i.e. the up-down direction, as illustrated in FIG. 7. With such a structure, the first contact portion 52 and the contact portion 44 of the first contact 40 can press the connection object 10 from above and below, as illustrated in FIG. 10. Thus, the reliability of the contact between the first contact portion 52 and the ground layer 13 of the connection object 10 and the reliability of the contact between the contact portion 44 of the first contact 40 and the conductive layer 11 of the connection object 10 can be enhanced.

The support portion 56 illustrated in FIG. 8 supports the first arm portion 51 and the second arm portion 54. For example, the upper part of the support portion 56 is connected to the back end of the first arm portion 51. The lower part of the support portion 56 is connected to the back end of the second arm portion 54.

The upper part of the support portion 56 has a projection portion 57, as illustrated in FIG. 8. The projection portion 57 bites into the upper inner surface of the second insertion opening 33 of the insulator 30. The lower part of the support portion 56 is supported by the lower inner surface of the second insertion opening 33 of the insulator 30. With such a structure, the second contact 50 is held in the second insertion opening 33.

The mounted portion 58 projects backward from the back surface of the insulator 30, as illustrated in FIG. 8. The lower surface of the mounted portion 58 is located lower than the lower surface of the insulator 30. The mounted portion 58 is mounted on the ground pattern on the circuit board CB illustrated in FIG. 1. For example, the mounted portion 58 is mounted by being placed on a solder paste applied on the circuit board CB.

The fixed metal fittings 60 illustrated in FIGS. 3 and 4 are obtained by press forming any metal plate. The two fixed metal fittings 60 are located on the right and left sides of the insulator 30. The fixed metal fittings 60 are fixed to the insulator 30 by being press-fitted into the installation grooves 34 of the insulator 30 from front. The fixed metal fittings 60 each include a support portion 61 and a mounted portion 62, as illustrated in FIGS. 3 and 4.

The support portion 61 extends backward from the mounted portion 62, as illustrated in FIGS. 3 and 4. The support portion 61 supports the actuator 70.

The mounted portion 62 is approximately L-shaped, as illustrated in FIGS. 3 and 4. The mounted portion 62 is mounted on the circuit board CB illustrated in FIG. 1. For example, the mounted portion 62 is mounted on the circuit board CB by being placed on a solder paste applied on the circuit board CB. The mounted portion 62 may have a through hole, as illustrated in FIGS. 3 and 4. As a result of the mounted portion 62 having the through hole, when mounting the mounted portion 62 on the circuit board CB, the solder easily gathers in the through hole. As a result of the solder easily gathering in the through hole, the fixing strength of the mounted portion 62 to the circuit board CB can be improved. As a result of the solder easily gathering in the through hole, excess solder can be prevented from climbing up.

The actuator 70 is a bilaterally symmetrical plate-shaped member as illustrated in FIGS. 3 and 4. The actuator 70 may be formed in a plate shape by injection molding an insulating and heat-resistant synthetic resin material. The actuator 70 is rotatable with respect to the insulator 30. The actuator 70 includes side portions 71, through holes 72, insertion grooves 73, the rotation shaft 74 (engaged portion), a flat portion 75, and a flat portion 76, as illustrated in FIGS. 3 and 4.

The side portions 71 are located at the right and left ends of the actuator 70, as illustrated in FIGS. 3 and 4. The respective base ends 71*a* of the right and left side portions 71 on the rotation shaft 74 side are placed on the respective support portions 61 of the right and left fixed metal fittings 60.

The through holes 72 are formed near the lower edge of the actuator 70. The through holes 72 are formed side by side in the right-left direction of the actuator 70. The through holes 72 are formed through the actuator 70 in the front-back direction, as illustrated in FIG. 4. The recess 42 of the first contact 40 is inserted into each through hole 72, as illustrated in FIG. 7.

The insertion grooves 73 illustrated in FIG. 3 are formed near the lower edge of the actuator 70. The insertion grooves 73 are located at the right and left ends of the actuator 70. The insertion grooves 73 are formed through the actuator 70 in the front-back direction, as illustrated in FIG. 4. Part of the first arm portion 51 of the second contact 50 is inserted into each insertion groove 73, as illustrated in FIG. 8.

The rotation shaft 74 illustrated in FIG. 3 is formed so as to block part of the through hole 72. The rotation shaft 74 engages the recess 42 of the first contact 40, as illustrated in FIG. 7. As a result of the base ends 71*a* of the side portions 71 being supported by the support portions 61 of the fixed metal fittings 60 as mentioned above, the engagement relationship between the rotation shaft 74 and the recess 42 of each first contact 40 corresponding to the rotation shaft 74 is maintained. More specifically, as a result of the base ends 71*a* of the side portions 71 being supported by the support portions 61 of the fixed metal fittings 60, the rotation shaft 74 can be prevented from falling off the recess 42 of the first contact 40. With such a structure, the actuator 70 can rotate about the rotation shaft 74 with respect to the insulator 30.

The flat portion 75 is continuously provided between the right and left side portions 71 of the actuator 70, as illustrated in FIG. 4. More specifically, the flat portion 75 is continuous in the right-left direction, and is formed as a plane at the back lower edge of the actuator 70 illustrated in FIG. 4. The flat portion 75 is located higher than the upper inner surface of the insertion groove 31 of the insulator 30 when the actuator 70 is in the open state. With such a structure, when inserting the connection object 10 into the insertion groove 31, the connection object 10 can be prevented from coming into contact with the lower edge of the actuator 70. Thus, when the actuator 70 is in the open state, the connection object 10 can be easily inserted into the insertion groove 31.

The flat portion 76 is provided between the right and left side portions 71 of the actuator 70, as illustrated in FIG. 3. The flat portion 76 is formed as a plane on the front lower side of the actuator 70 illustrated in FIG. 3. When the actuator 70 is in the closed state, the flat portion 76 comes into contact with the surface of the connection object 10 and presses the connection object 10 downward, as illustrated in FIG. 9. With such a structure, the reliability of the contact between the contact portion 44 of each first contact 40, etc. and the connection object 10 can be enhanced.

As described above, in the connector 20 according to this embodiment, each second contact 50 as a ground terminal includes the first arm portion 51 including the first contact portion 52 and the second arm portion 54 including the second contact portion 55, as illustrated in FIG. 10. By the first contact portion 52 and the second contact portion 55, the connector 20 according to this embodiment can electrically connect to the conductive layers formed on both surfaces of the connection object 10, i.e. the ground layers 12 and 13. In the case where the connection object 10 includes only one of the ground layers 12 and 13, too, the connector 20 according to this embodiment can electrically connect to the ground layer 12 or 13 included in the connection object 10 by the first contact portion 52 or the second contact portion 55. In other words, even in the case where a conductive layer is formed only on one surface of the connection object 10, the connector 20 according to this embodiment can electrically connect to the conductive layer by the first contact portion 52 or the second contact portion 55. Therefore, according to this embodiment, the cable connector 20 capable of electrical connection without being affected by whether a ground layer is formed on one surface or both surfaces of the plate-shaped connection object can be provided.

Connectors are increasingly miniaturized in recent years. The miniaturization of connectors involves reduction in the arrangement intervals of the contacts in the connector (the arrangement intervals of the first contacts 40 and the second contacts 50 in the right-left direction in the example illustrated in FIG. 3). Even in such a case, according to this embodiment, the first contacts 40 and the second contacts 50 can adapt to narrow arrangement intervals because they are formed only by blanking a material which is a thin plate as mentioned above. As a result of the first contacts 40 and the second contacts 50 being formed only by blanking, the first contacts 40 and the second contacts 50 can be easily produced even with complex shapes.

The connector 20 described above is mounted in an electronic device. Examples of the electronic device include any on-vehicle devices such as a camera, a radar, a drive recorder, and an engine control unit. Examples of the electronic device include any on-vehicle devices used in vehicle-mounted systems such as a car navigation system, an advanced driving support system, and a security system. Examples of the electronic device include any information devices such as a personal computer, a copier, a printer, a mobile terminal, a facsimile machine, and a multifunction machine. Examples of the electronic device include any industrial devices.

While some embodiments and examples of the present disclosure have been described above by way of drawings, various changes or modifications may be easily made by those of ordinary skill in the art based on the present disclosure. Such various changes or modifications are therefore included in the scope of the present disclosure. For example, the functions included in the functional units, etc. may be rearranged without logical inconsistency, and a plurality of functional units, etc. may be combined into one functional unit, etc. and a functional unit, etc. may be divided into a plurality of functional units, etc. Moreover, each of the disclosed embodiments is not limited to the strict implementation of the embodiment, and features may be combined or partially omitted as appropriate.

For example, in the second contact 50 illustrated in FIG. 6, the second contact portion 55 may be a part of the elastic piece, as with the first contact portion 52. With such a structure, the displacement by the elastic deformation of the second contact portion 55 can be increased. As a result of the displacement by the elastic deformation of the second contact portion 55 being increased, the reliability of the contact between the second contact portion 55 and the ground layer 12 illustrated in FIG. 10 can be enhanced.

Figure 11:
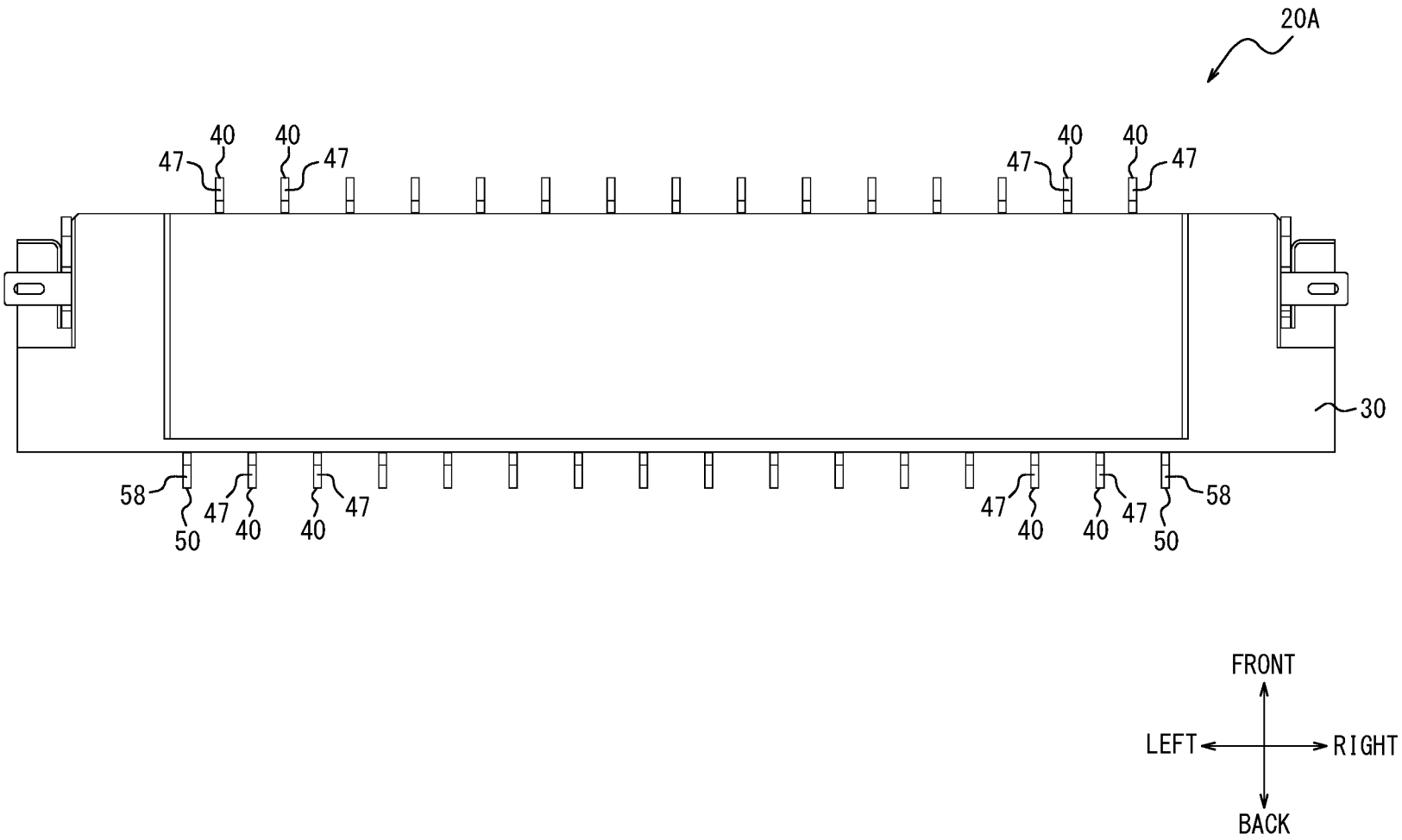
FIG. 11 is a bottom view of a connector according to a modification.

For example, the first contacts 40 and the second contacts 50 illustrated in FIG. 3 may not be arranged in one line in the right-left direction. The first contacts 40 and the second contacts 50 may be, for example, arranged in two lines in the right-left direction, as illustrated in FIG. 11. FIG. 11 is a bottom view of a connector 20A according to a modification. Some first contacts 40 and the second contacts 50 in FIG. 11 are arranged at the back edge of the insulator 30 in the right-left direction. The other first contacts 40 in FIG. 11 are arranged at the front edge of the insulator 30 in the right-left direction. With such a structure, the interval between the first contact 40 and the second contact 50 and the interval between adjacent first contacts 40 can be reduced.

Although the foregoing embodiment describes the case where the first contacts 40 and the second contacts 50 are arranged at predetermined intervals, the present disclosure is not limited to such. For example, the arrangement intervals of the first contacts 40 and the arrangement intervals of the second contacts 50 may be different. In this case, the first contacts 40 may be arranged at first intervals, and the second contacts 50 may be arranged at second intervals greater than the first intervals.

REFERENCE SIGNS LIST

10 connection object
11 conductive layer
12, 13 ground layer
20, 20A connector
30 insulator
31 insertion groove
32 first insertion opening
33 second insertion opening
34 installation groove
35 bottom wall
40 first contact (first terminal)
41 first arm portion
42 recess (engaging portion)
43 second arm portion
44 contact portion
44*a* third contact portion
44*b* fourth contact portion
45 support portion
46 projection portion
47 mounted portion
50 second contact (second terminal)
51 first arm portion
51*a* end
52 first contact portion
53 elastic piece
53*a* tip
54 second arm portion
55 second contact portion
56 support portion
57 projection portion
58 mounted portion
60 fixed metal fitting
61 support portion
62 mounted portion
70 actuator
71 side portion
71*a* base end
72 through hole
73 insertion groove
74 rotation shaft
75, 76 flat portion
CB circuit board

The invention claimed is:

1. A cable connector, comprising:

a first terminal;

a second terminal;

an insulator supporting said first terminal and said second terminal, and having an insertion groove into and from which a plate-shaped connection object is insertable and removable; and an actuator including an engaged portion that enables rotation with respect to said insulator, wherein said first terminal rotatably supports said actuator by an engaging portion that engages said engaged portion, said second terminal includes:

a first arm portion including a first contact portion configured to come into contact with one surface of said connection object by elastically deforming in a plate thickness direction of said connection object; and a second arm portion facing said first arm portion in said plate thickness direction, and including, at a tip thereof, a second contact portion configured to come into contact with an other surface of said connection object, said first contact portion of said second terminal is a part of an elastic piece that extends from an end of said first arm portion so as to be folded back, at said end, toward an insertion direction of said connection object, said first contact portion of said second terminal is located more to the side toward which said connection object is inserted, than said engaged portion of said actuator, and said second contact portion of said second terminal is located more to a side toward which said connection object is removed, than said first contact portion of said second terminal.

2. The cable connector according to claim 1, wherein said first terminal includes a third contact portion and a fourth contact portion each configured to come into contact with the other surface of said connection object, and said third contact portion is located more to the side toward which said connection object is removed, than said fourth contact portion.

3. The cable connector according to claim 2, wherein a distance between said first contact portion of said second terminal and said third contact portion or said fourth contact portion of said first terminal in the plate thickness direction of said connection object is less than a plate thickness of said connection object.

4. The cable connector according to claim 1, wherein said actuator is configured to rotate between a closed state and an open state, the closed state being a state in which said actuator is closed as a result of rotating with respect to said insulator toward the side toward which said connection object is removed, the open state being a state in which said actuator is open as a result of rotating with respect to said insulator toward the side toward which said connection object is inserted, and when said actuator is in said open state, said end of said first arm portion does not project more toward the side toward which said connection object is removed than said actuator.

5. The cable connector according to claim 1, wherein a distance between said first contact portion and said second contact portion in the plate thickness direction of said connection object is less than a plate thickness of said connection object.

6. The cable connector according to claim 1, wherein said second terminal is located at both ends of an arrangement of said first terminals.

* * * * *